US008335340B2

(12) United States Patent
de Haan

(10) Patent No.: US 8,335,340 B2
(45) Date of Patent: Dec. 18, 2012

(54) LOUDSPEAKER

(75) Inventor: Philip Derek Eduard de Haan, Zwaag (NL)

(73) Assignee: Alcons Audio B.V., Zwaag (NL)

( * ) Notice: Subject to any disclaimer, the term of this patent is extended or adjusted under 35 U.S.C. 154(b) by 208 days.

(21) Appl. No.: 12/527,762

(22) PCT Filed: Feb. 14, 2008

(86) PCT No.: PCT/NL2008/050084

§ 371 (c)(1), (2), (4) Date: Oct. 21, 2009

(87) PCT Pub. No.: WO2008/103034

PCT Pub. Date: Aug. 28, 2008

(65) Prior Publication Data

US 2010/0067731 A1 Mar. 18, 2010

(30) Foreign Application Priority Data

Feb. 21, 2007 (NL) ..... 2000499

(51) Int. Cl.
*H04R 1/00* (2006.01)

(52) U.S. Cl. ..... 381/431; 381/398; 381/399; 381/408

(58) Field of Classification Search ..... 381/408, 381/431, 398–399

See application file for complete search history.

(56) References Cited

U.S. PATENT DOCUMENTS

| | | | | | |
|---|---|---|---|---|---|
| 3,873,784 | A * | 3/1975 | Doschek | ..... | 381/186 |
| 4,037,061 | A * | 7/1977 | von Recklinghausen | ..... | 381/408 |
| 4,723,296 | A * | 2/1988 | Nieuwendijk et al. | ..... | 381/399 |
| 4,803,733 | A * | 2/1989 | Carver et al. | ..... | 381/398 |
| 5,021,613 | A * | 6/1991 | Garcia | ..... | 381/399 |
| 5,283,836 | A * | 2/1994 | Trufitt | ..... | 381/428 |
| 5,850,461 | A * | 12/1998 | Zelinka | ..... | 381/398 |
| 6,104,825 | A * | 8/2000 | Thigpen | ..... | 381/408 |
| 6,185,310 | B1 * | 2/2001 | Kermani et al. | ..... | 381/431 |
| 7,146,017 | B2 * | 12/2006 | Steere et al. | ..... | 381/176 |
| 7,254,248 | B2 * | 8/2007 | Johannsen et al. | ..... | 381/409 |
| 2005/0271230 | A1 | 12/2005 | Sasaki | | |

FOREIGN PATENT DOCUMENTS

| | | | |
|---|---|---|---|
| JP | 51-89411 | | 8/1976 |
| JP | 2004-193811 | A | 7/2004 |
| JP | 2006-519568 | A | 8/2006 |
| WO | 2004/080119 | A1 | 9/2004 |
| WO | 2005/104613 | A1 | 11/2005 |

* cited by examiner

*Primary Examiner* — Curtis Kuntz

*Assistant Examiner* — Ryan Robinson

(74) *Attorney, Agent, or Firm* — The Webb Law Firm

(57) ABSTRACT

A loudspeaker comprising a housing provided with a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting at least part of the membrane in motion so as to produce sound, wherein a part of the conductor pattern extends beyond the plane of the aforesaid movable part of the membrane near at least one end of the membrane. Preferably, the aforesaid part of the conductor pattern makes an angle of about 90 degrees with the aforesaid movable part of the membrane.

5 Claims, 3 Drawing Sheets

LOUDSPEAKER

BACKGROUND OF THE INVENTION

1) Field of the Invention

The invention relates to a loudspeaker comprising a housing provided with a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting at least part of the membrane in motion so as to produce sound.

2) Description of Related Art

Such a loudspeaker is described in International patent application WO 2004/080119. The loudspeaker disclosed therein has a high power level and a cylindrical wavefront, and because of these properties it is used in larger spaces, such as concert halls, theatres and cinemas. Because the length of the membrane is bound to a maximum, due to physical limitations, several loudspeakers are placed one on top of the other and connected together (a so-called "line array") to obtain a sufficient power level and an optimum cylindrical wavefront, so that one elongated ribbon-shaped vibration area is obtained. A limitation in this regard is the fact that said vibration area is interrupted by the upper and lower ends of the housing which accommodates the substantially horizontal conductor parts that interconnect the vertical parts of the conductor on the membrane. In practice the vibration area of the membranes thus takes up about 80% of the height of the loudspeaker assembly.

SUMMARY OF THE INVENTION

The object of the invention is to provide a loudspeaker of the kind referred to in the introduction, which makes it possible to increase the vibration area percentage in an assembly in a simple and efficient manner and/or which exhibits improved mechanical and/or acoustic properties in comparison with known loudspeaker assemblies.

In order to accomplish that object, a part of the conductor pattern extends beyond the (continuous, geometric) plane of the aforesaid movable part of the membrane near at least one (upper and/or lower) end of the membrane. Said parts of the conductor pattern are the substantially horizontal conductor parts at the upper and lower ends of the conductor pattern, which are fixed in or on the upper and lower ends of the housing and which do not contribute to the motion of the membrane for producing sound. The term "substantially horizontal conductor parts" is understood to mean conductor parts which are different from the vertical conductor parts on the movable part of the membrane in the case of a loudspeaker which is vertically oriented. In the preferred embodiment shown herein, said conductor parts are the semi-circular conductor parts.

This makes it possible to reduce the vertical dimension of the upper and lower edges of the housing and to arrange the movable parts of the membrane in a vertical assembly closer together and thus obtain a vibration area larger than the aforesaid 80%, for example. Furthermore this makes it possible to arrange the membranes of the various loudspeakers in a vertical/horizontal assembly at an angle relative to each other without any significant loss of vibration area, in such a manner that a greater vertical/horizontal emission of sound will be realised.

Preferably, the aforesaid part of the conductor pattern that extends beyond the plane of the aforesaid movable part of the membrane makes an angle of 45-180 degrees, more preferably an angle of about 90 degrees, with the (end of the) aforesaid movable part of the membrane. This includes the possibility that said folded part comprises multiple folds and thus makes various angles with the movable part of the membrane, or the possibility that said part is curved or rolled up.

In the preferred embodiment, the aforesaid part of the conductor pattern is provided on a folded end face part of the frame. In the preferred embodiment, the conductor pattern comprises an electrically conductive wire provided in an elongated coil on the membrane and the frame, with straight parts of the wire in said elongated coil extending on the movable part of the membrane and curved parts of the wire in the short sides of the elongated coil extending on the folded end face part of the frame.

In the preferred embodiment, the part of the conductor pattern that extends beyond the plane of the aforesaid movable membrane abuts against or is positioned very close to the outer wall of a short side of the housing. As a result, said conductor parts of two adjacent loudspeakers can be arranged substantially in abutment with each other.

The invention further relates to a loudspeaker assembly comprising at least two of the aforesaid loudspeakers, wherein two short sides of the loudspeakers at least substantially touch one another. Preferably, parts of the conductor pattern extend beyond the plane of the movable part of the membrane near two opposite ends of the membrane.

BRIEF DESCRIPTION OF THE DRAWINGS

The invention will now be explained in more detail on the basis of an embodiment as shown in the figures, in which functionally like parts are indicated by the same numerals, and in which.

DETAILED DESCRIPTION OF THE INVENTION

Figure 1:
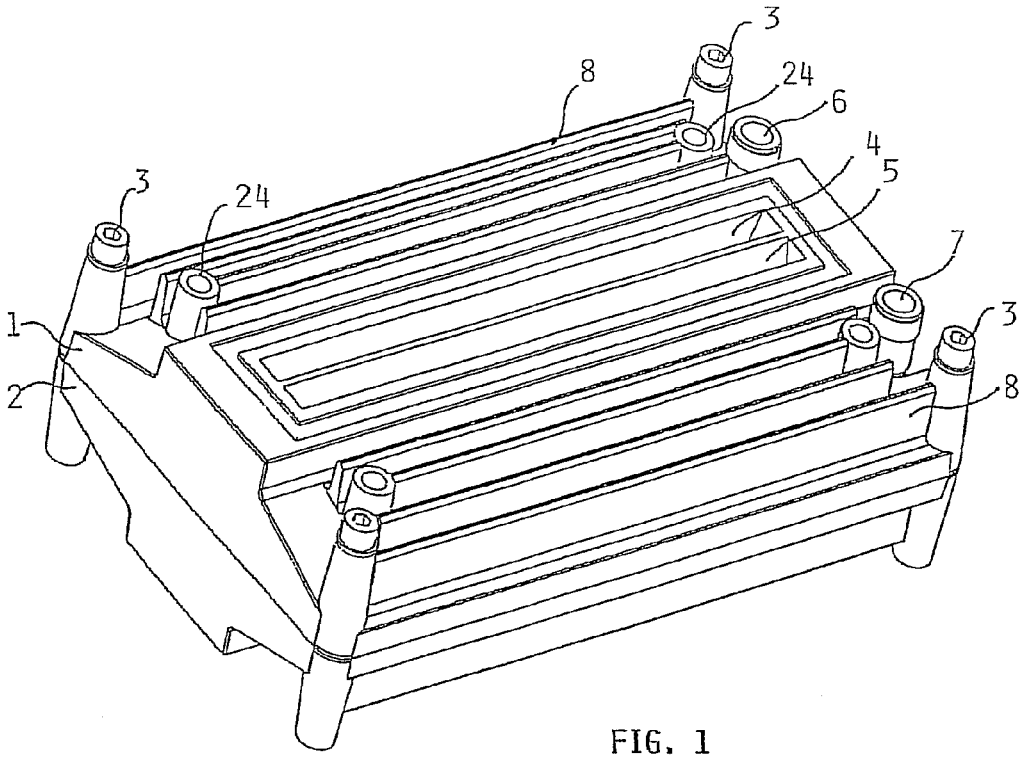
FIG. 1 is a perspective view of a loudspeaker.
Figure 5:
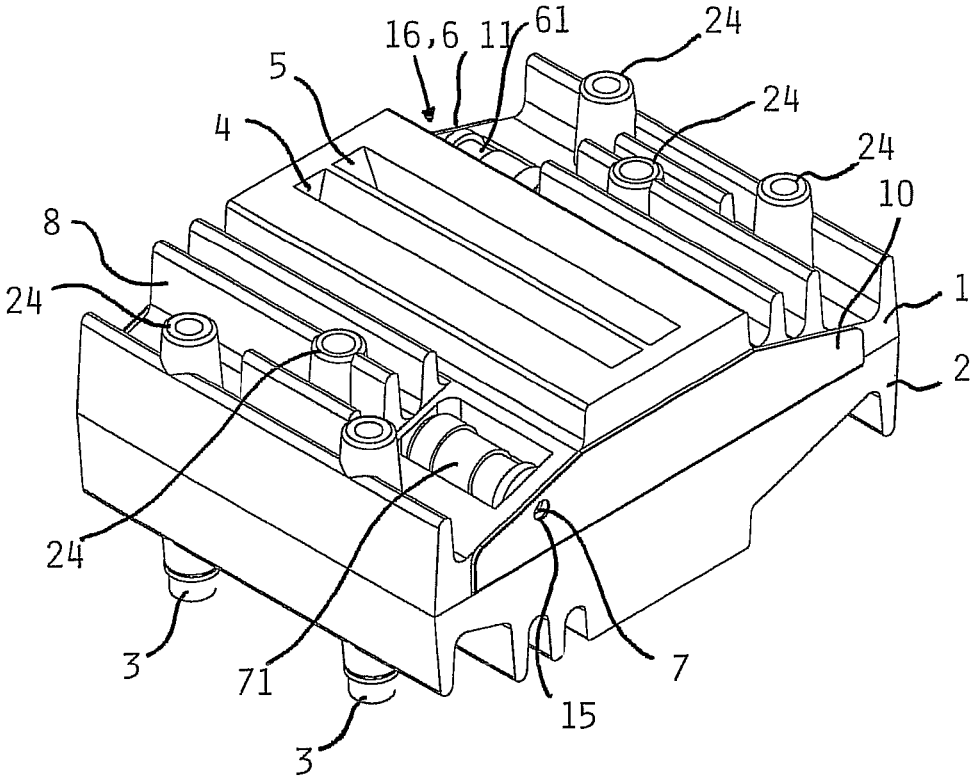
FIG. 5 is a partially perspective view of a loudspeaker according to the invention.

According to FIGS. 1 and 5, a loudspeaker comprises a housing which consists of two substantially identical metal parts 1, 2, which are fastened together by means of screws 3. Each housing part 1, 2 has two elongated, slot-shaped recesses or sound channels 4, 5, which guide the sound generated in the loudspeaker towards the outside. A housing part 1 is furthermore provided with electrical connection points 6, 7, to which the sound signal wires of an amplifier can be connected. The housing 1, 2 is provided with cooling ribs 8 extending outwardly and in the longitudinal direction, which function to dissipate the heat that is generated in the loudspeaker.

Figure 2:
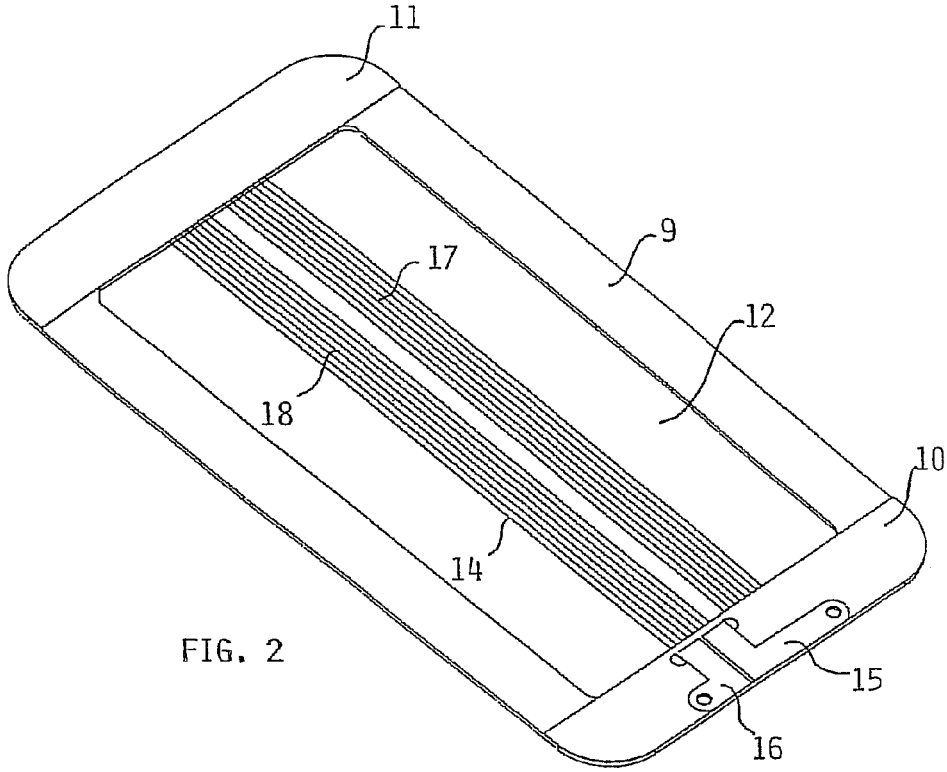
FIG. 2 is a perspective view of the membrane unit.

The housing parts 1, 2 enclose a frame, which, in the embodiment shown in FIG. 2, consists of a first window-shaped frame member 9 and two strip-shaped frame members 10, 11. The frame members 9, 10, 11 are preferably made of copper or anodised aluminium. The outer surface of the frame members 9, 10, 11 is in full contact with the housing 1, 2. A flat vibrating membrane 12 is affixed to the frame member 9 by means of a glue or by means of a thin, double-sided adhesive tape. Said glue or tape is of a heat-conducting type. Provided on the membrane 12 is an electrical conductor pattern 14, which is connected to the connection points 6, 7, and which causes the membrane to vibrate when the amplifier sends an electrical signal through the loudspeaker.

Figure 3:
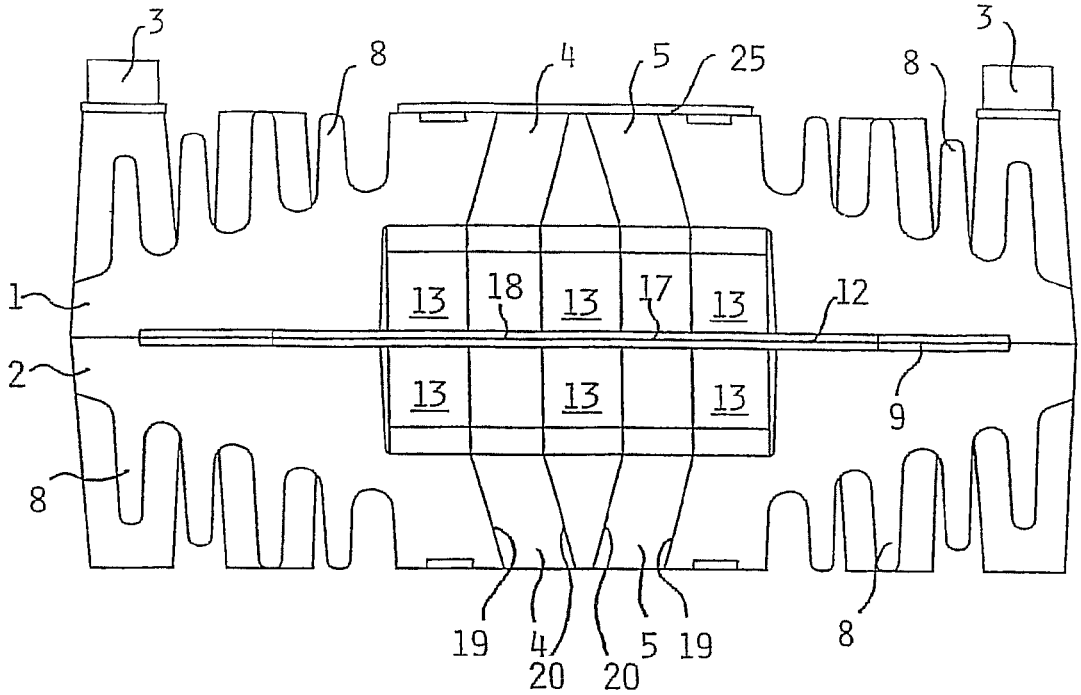
FIG. 3 is a cross-sectional view of the loudspeaker of FIG. 1.

To that end the loudspeaker comprises magnets 13, as shown in FIG. 3, which generate a permanent magnetic field in which the conductor pattern 14 of the membrane 12 is located. The conductor pattern 14 is formed by an electrically conductive wire I, which is arranged in an elongated, rectangular coil on one side of the membrane 12. On the short sides of the rectangular pattern, the frame members 10, 11 are provided directly on the conductor pattern. Consequently, the glue or the tape by means of which said frame members are affixed to the conductive wire must be electrically insulating. On the other short side of the membrane 12, said short sides of the pattern are likewise covered, viz. by the short sides of the window-shaped frame member 9. In this way the conductor pattern 14 can transfer heat to the frame members 9, 10, 11 on both sides.

The two ends of the conductive wire are connected to power connections 15, 16 on the frame member 10, which are in turn electrically connected to the connection points 6, 7. The power connections 15, 16 are electrically isolated from the frame member 10. The lines of the conductor pattern 14 that extend parallel to each other in the longitudinal direction between the frame members 10, 11 form two spaced-apart vibration areas 17, 18.

Referring to FIG. 3, the sound channels 4, 5 extend from a position near the two spaced-apart vibration areas 17, 18 on the surface of the membrane 12 to the outer side of the housing parts 1, 2, whilst the sound channels 4, 5 are closed by a closing plate 25 on one side, however, because the loudspeaker must emit the sound to one side only. The sound channels 4, 5 first extend perpendicularly away from the membrane, seen from the membrane, viz. in the area between the magnets 13, and subsequently the sound channels 4, 5 incline towards each other. Both the outer walls 19 and the inner walls 20 of each sound channel 4, 5 incline towards each other, whilst the inner wall 19 and the outer wall 20 of a sound channel 4, 5 continue to extend parallel to each other. At the outer side of the loudspeaker, the distance that remains between the inner walls 19 of the two sound channels 4, 5 is only very small, at least several times smaller than the distance between the vibration areas 17, 18. In this way the fronts of the sound waves generated by the two vibration areas 17, 18 are guided towards each other and joined together, thus preventing harmful interference between the two wavefronts.

Figure 4:
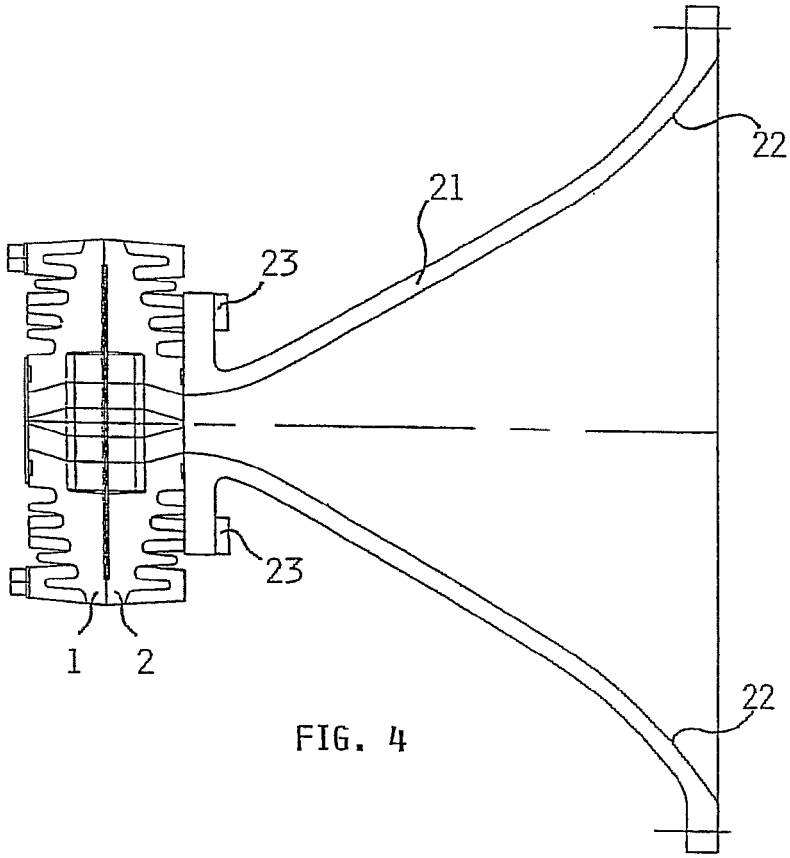
FIG. 4 is a cross-sectional view of the loudspeaker of FIG. 1, on which a sound horn is mounted.

FIG. 4 shows a sound horn 21, which is mounted in threaded holes of the loudspeaker by means of screws 23. The outer walls 19 of the sound channels 4, 5 join the walls 22 of the sound horn 21. The sound horn 21 effects a gradual extension of the sound front that leaves the sound channels 4, 5 before said sound front further extends into the environment. The horn, which is preferably made of a metal, contributes to the heat dissipation of the loudspeaker.

The housing shown in FIG. 5 has its two electrical connection points 6, 7 at diagonally opposed ends of the housing, which form the ends of two spring terminals 61, 71 accommodated in the housing. Said spring terminals are connected, by means of two bolts (not shown), to the respective electrically conductive frame members 10, 11, which are each in turn connected to an end of the conductor 14 on the membrane 12.

Figure 6:
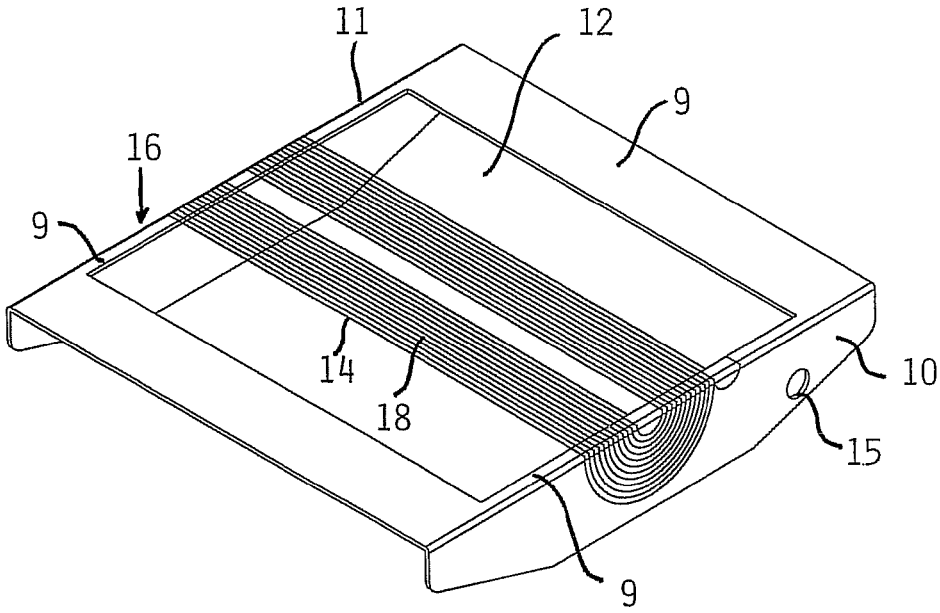
FIG. 6 is a perspective view of a membrane unit according to the invention.

According to the embodiment shown in FIG. 6, the frame 9 consists of a window-shaped frame member comprising two frame members 10, 11 at the two short ends thereof, which are folded through an angle of 90 degrees to one side. Provided on the frame members 10, 11 are the membrane parts comprising the conductor parts which interconnect the conductor parts extending in the longitudinal direction in the vibration areas 17, 18 and which do not contribute to the vibration of the membrane so as to produce sound. The folded frame members 10, 11 are folded against the outer wall of the edge at the short sides of the housing part 1 and attached thereto. As a result, the longitudinal dimension of the edge at the ends of the housing 1, 2 is smaller than in the embodiment of FIG. 1, and in a loudspeaker assembly in which said ends are positioned in abutment with each other, the distance between the ends of the vibration areas 17, 18 of two adjacent loudspeakers becomes smaller. The reduction of said distance is represented by the width of the folded frame members 10, 11.

The invention claimed is:

1. A loudspeaker assembly comprising at least two loudspeakers, each loudspeaker comprising a housing provided with a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting at least part of the membrane in motion so as to produce sound, wherein a first part of the conductor pattern of each loudspeaker extends along a plane defined by the aforesaid movable part of the membrane and a second part of the conductor pattern of each loudspeaker is provided on a folded end face part of the frame and extends out of the plane of the aforesaid movable part of the membrane near at least one end of the membrane and abuts against or is positioned very close to an outer wall of a short side of the housing, and the end faces of said short sides of said loudspeakers at least substantially touch one another.

2. The loudspeaker assembly according to claim 1, wherein the aforesaid second part of the conductor pattern makes an angle of 45-180 degrees with the aforesaid movable part of the membrane.

3. The loudspeaker assembly according to claim 1, wherein the aforesaid second part of the conductor pattern makes an angle of about 90 degrees with the aforesaid movable part of the membrane.

4. The loudspeaker assembly according to claim 1, wherein the conductor pattern comprises an electrically conductive wire provided in an elongated coil on the membrane and the frame, with straight parts of the wire in said elongated coil extending on the movable part of the membrane and curved parts of the wire in the short sides of the elongated coil extending on the folded end face part of the frame.

5. The loudspeaker assembly according to claim 1, wherein parts of the conductor pattern extend out of the plane of the movable part of the membrane near two opposite ends of the membrane.

* * * * *